US006719612B2

(12) United States Patent
Visaisouk et al.

(10) Patent No.: US 6,719,612 B2
(45) Date of Patent: Apr. 13, 2004

(54) ICE BLAST CLEANING CABINET

(75) Inventors: Sam Visaisouk, Mercer Island, WA (US); Norman W. Fisher, Bellevue, WA (US)

(73) Assignee: Universal Ice Blast, Inc., Kirkland, WA (US)

( * ) Notice: Subject to any disclaimer, the term of this patent is extended or adjusted under 35 U.S.C. 154(b) by 0 days.

(21) Appl. No.: 09/858,151

(22) Filed: May 14, 2001

(65) Prior Publication Data

US 2002/0168924 A1 Nov. 14, 2002

(51) Int. Cl.[7] ..... B24C 3/04
(52) U.S. Cl. ..... 451/39; 451/89; 451/53
(58) Field of Search ..... 451/38, 39, 40, 451/53, 75, 87, 88, 89, 99, 80–83; 134/7

(56) References Cited

U.S. PATENT DOCUMENTS

| | | | | | |
|---|---|---|---|---|---|
| 3,824,739 | A | * | 7/1974 | Moret et al. | 451/53 |
| 5,025,597 | A | * | 6/1991 | Tada et al. | 451/75 |
| 5,367,838 | A | * | 11/1994 | Visaisouk et al. | 451/39 |
| 5,419,733 | A | * | 5/1995 | Johnson et al. | 451/39 |
| 6,113,475 | A | * | 9/2000 | Masuda et al. | 451/83 |

FOREIGN PATENT DOCUMENTS

| | | | | | |
|---|---|---|---|---|---|
| DE | 40 22 401 | A1 | | 1/1991 | |
| DE | 4022401 | | * | 1/1991 | 451/75 |
| JP | 58-223563 | | * | 12/1983 | 451/39 |
| JP | 63-156661 | A | | 6/1988 | |
| JP | 63-156661 | | * | 6/1988 | 451/2 |
| JP | 1-171766 | A | | 7/1989 | |
| JP | 1-171766 | | * | 7/1989 | 451/88 |
| WO | WO 02/092283 | A2 | | 11/2002 | |

* cited by examiner

*Primary Examiner*—Robert A. Rose
(74) *Attorney, Agent, or Firm*—Christensen O'Connor Johnson Kindness PLLC

(57) ABSTRACT

A blast cabinet (10) for ice blasting an article, the cabinet comprising a housing (11) having an interior support (19) for supporting the article. At least one ice blast nozzle (80) is disposed inside the housing and operable to direct a high speed stream of ice particles towards the article. In an embodiment the ice blast nozzle(s) is mounted on a articulated mount (82) wherein the nozzle can be articulated. An energy management system (30, 130) comprising a heating system is provided to facilitate the removal of spent ice particles, and prevent ice accumulation in the enclosure. In an embodiment of the blast cabinet, the energy management system (130) includes a piping assembly (36) a heat exchanger (37) both disposed in the housing. Relatively warm heat exchanger fluid is circulated through the piping assembly and heat exchanger, then the cooled fluid is circulated through an external compressor (51), providing cooling to the compressor and reheating the heat exchanger fluid prior to recirculation through the piping assembly.

21 Claims, 7 Drawing Sheets

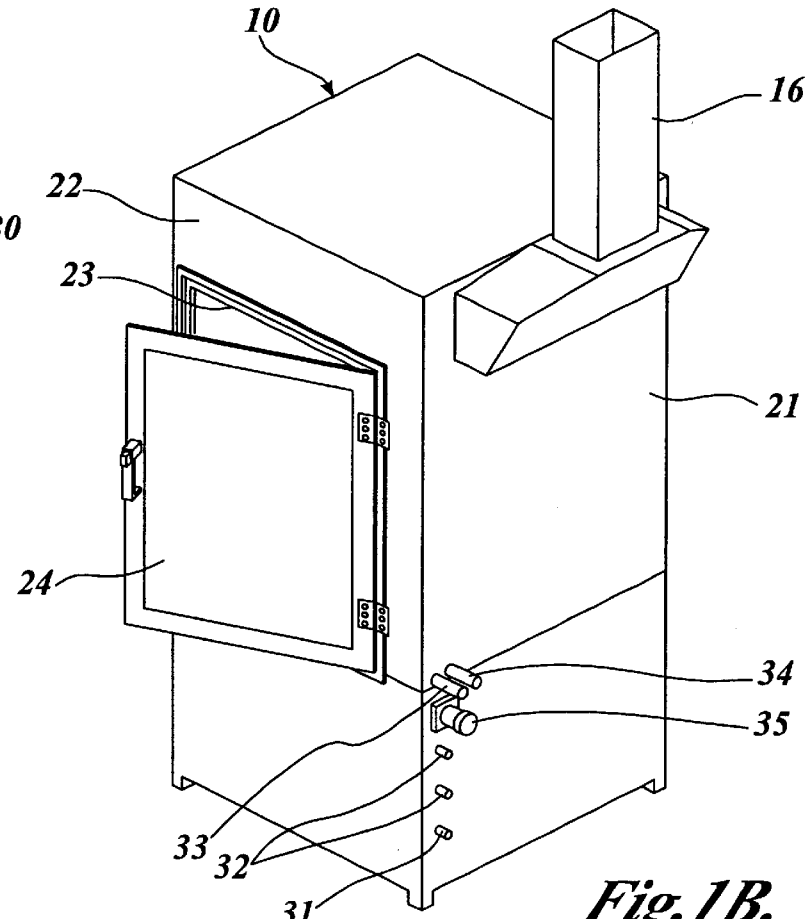
Fig. IB.
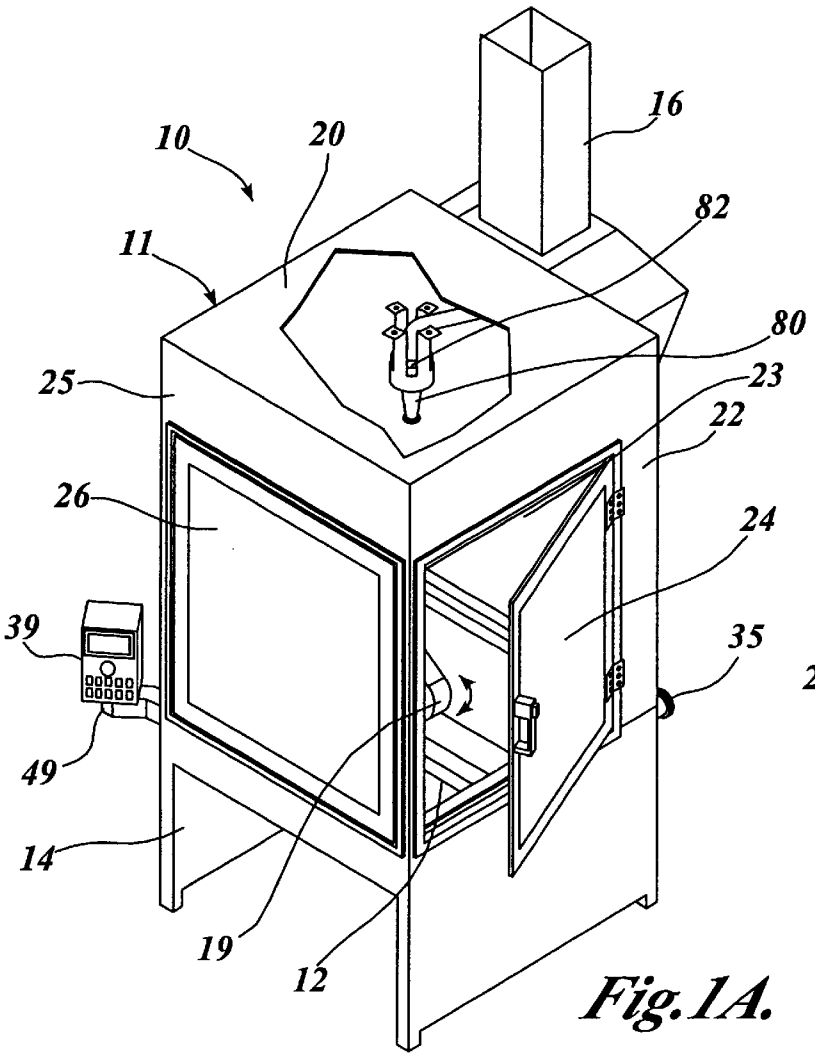
Fig. IA.

ICE BLAST CLEANING CABINET

FIELD OF THE INVENTION

This invention relates to blast cabinets and in particular to a blast cabinet suitable for use in automated or manual parts cleaning utilizing ice particle blasting media.

BACKGROUND OF THE INVENTION

Abrasive blasting has been used for many years as a means for removing undesirable materials from objects. In abrasive blasting a high velocity stream of an abrasive blast media, entrained in a gas or liquid stream, are directed at the object to be treated to remove undesired materials. Abrasive blasting is used in applications ranging from cleaning and deburring machined parts to ship hull cleaning. Conventional abrasive blast media include materials such as steel shot, glass beads, aluminum oxide and the like.

Ice blast technology differs from abrasive blasting. For example, ice blasting utilizes a high-speed stream of small ice particles rather than an abrasive blast media to remove undesired materials from an object. Ice blasting is useful for polishing and removing surface contaminants, coatings, burrs and the like. An apparatus and method for continuously delivering ice particulates at high velocity is disclosed in U.S. Pat. No. 6,001,000 which is assigned to the assignee of the present invention, and is hereby incorporated by reference. Ice blast technology has been shown to be highly effective in cleaning due to the scrubbing mechanism of ice particles on impact, and the rinsing mechanism of the spent ice after impact. As a result, many applications emerged for ice blast cleaning. A typical ice blasting apparatus entrains ice particles in an air stream that propels the ice particles at high speed towards the article to be treated. In article cleaning applications, ice blasting can eliminate or reduce the use of environmentally unfriendly cleaning chemicals that might otherwise be used to clean the articles. With increasingly more stringent environmental regulations, many manufacturing and repair shops that routinely use chemicals for degreasing and cleaning of tools and parts are forced to find alternative cleaning methodologies.

While open blasting (i.e. blasting in an open area) is effective for many applications, the open blasting process is noisy and typically produces a lot of blast spray that may contain grease and/or other materials removed from the treated object. Such open blasting is not desirable or practical in certain applications, and may not conform with EPA and OSHA requirements. As an alternative to open abrasive blasting, a blast cabinet is sometimes used to provide an enclosed compartment for performing the abrasive blasting process. For example, automobile manufacturers sometimes use blast cabinets to remove surface applications from improperly painted automobile body parts, prior to repainting. Blast cabinets are also used in cleaning used machine parts that are to be salvaged and/or refurbished.

In conventional blast cabinets an abrasive blasting material is typically entrained in a high-speed gas or liquid jet and directed towards the article to be treated. The kinetic energy of the abrasive blasting material, in combination with the liquid or gas jet, is used to dislodge and/or remove undesired materials from the article, such as dirt, oils, paint, rust or other oxidized layers, burrs and the like. Although conventional blast cabinets are effective for many applications, they have some disadvantages. For example, the abrasive blast media itself must be properly handled. It is often necessary or desirable to recycle the abrasive blasting material, which requires a system for recovering and separating the blasting material from the undesired materials being removed from the workpiece. When friable abrasives are used, the friable abrasives tend to generate a fog-like plume of particulates in the blasting cabinet that can obstruct the user's view of the workpiece, and create an undesirable work environment.

U.S. Pat. Nos. 5,177,911 and 5,556,324, for example, disclose blast cabinets that use dry abrasives which require dust control and blast media recycling. Such cabinets are not suitable for ice blasting, however, because, 1) the ice particles will accumulate in the blast cabinet over time; 2) ice blast is a generally wet process requiring water-tight and corrosion-resistant construction of the blast cabinet; and 3) the exhaust air produced during ice blasting is moisture laden, and therefore not suitable for direct discharge into a typical shop space. In addition, a portion of the ice blast media (ice particles) will not melt during the blasting operation, and in time can accumulate in a confined blast cabinet.

SUMMARY OF THE INVENTION

An ice blast cabinet provides an enclosed environment for cleaning surfaces of an article with an ice blast media is disclosed. The ice blast cabinet includes an enclosure defined by a lower tub-like portion with a drain, a peripheral wall and a top portion. A support for holding the article to be cleaned is provided within the enclosure. At least one ice blast nozzle is mounted within the cabinet and directs a stream of high speed ice particles toward the article. In one embodiment, the nozzle is mounted in the top portion of the cabinet, and directs ice downwardly on the workpiece. A de-icing energy management system in the enclosure is operable to melt any accumulations of ice particles to facilitate removal of the discharged ice blast media from the ice blast cabinet. In an embodiment of the invention, the de-icing system includes heating elements disposed in the enclosure.

In another embodiment of the invention, the de-icing system includes a heat exchanger disposed in the enclosure, wherein a heat exchanger fluid is circulated through the heat exchanger.

In a further aspect of the invention, relatively warm heat exchanger fluid is provided to the heat exchanger to facilitate de-icing, and the cooled heat exchanger fluid is then circulated through an external compressor to provide cooling to the compressor, prior to recirculating the fluid through the heat exchanger.

In another aspect of the invention, ducting is provided through the enclosure, and air is circulated through the ducting to provide air conditioning to an area outside of the blast cabinet.

In an embodiment of the invention directed to automated ice blast cleaning operations, the cabinet has side cut-outs for workpiece part entry and exit on a conveyor with automated speed or motion control. The blast nozzle may be stationary or articulated. For large and/or complex parts, more than one nozzle may be fitted within the cabinet.

In ice blast operation, the phase transitions of ice to water, and water mist to vapor, absorbs a huge amount of thermal energy. The present invention enables utilization of the thermal sink represented by the melting and vaporizing ice blast media, for example to increase the efficiency of the ice making process and/or to cool hot work areas or other machinery.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 1A and 1B are perspective views of an ice blast cabinet in accordance with the present invention.

DETAILED DESCRIPTION OF THE PREFERRED EMBODIMENT

Figure 2:
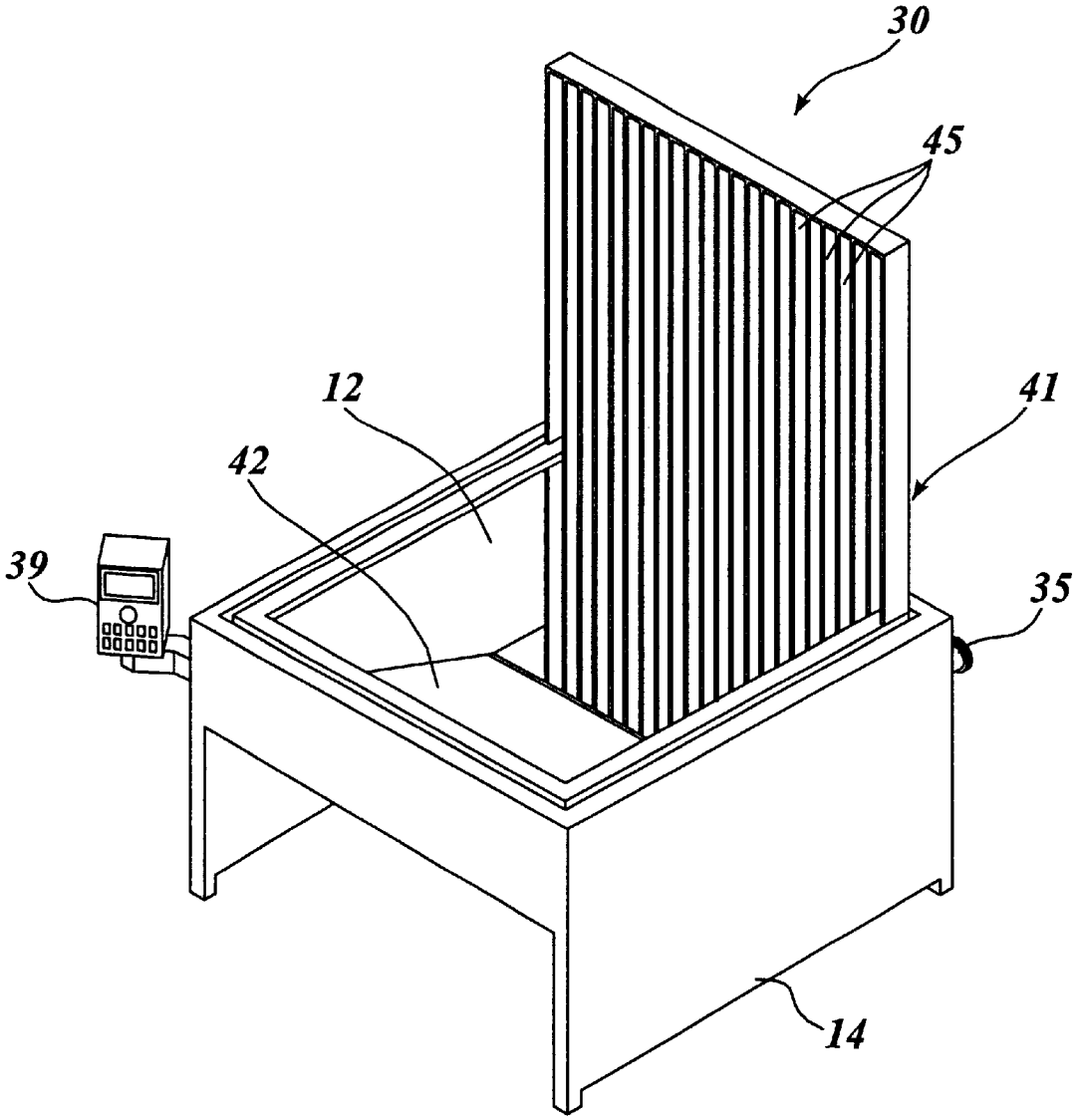
FIG. 2 is a perspective view of a first embodiment of an energy management system for the ice blast cabinet shown in FIGS. 1A and 1B.

A perspective drawing of a first embodiment of an ice blast cabinet made in accordance with the present invention is shown in FIGS. 1A and 1B. Ice blast cleaning operations include the dislodging and removal of surface materials such as grease, dirt, rust, paint and/or other tightly adherent coatings, machining burrs, casting flashings, and the like, by directing a stream of high velocity ice particles at the article to be cleaned. In a preferred embodiment the ice particles are entrained in an air stream, which is directed at high speed toward the article to be treated. Although the embodiment of the invention shown is depicted with doors providing manual access to the interior, it is contemplated that the ice blast cabinet 10 can be operated in either a manual mode or automated use mode, as discussed in more detail below.

The ice blast cabinet 10 includes an enclosure formed from a cabinet housing 11 having a generally water-tight lower section 12 supported on a lower frame structure 14. The housing 11 includes a top panel 20, a back wall 21, two side walls 22 (one shown) with access openings 23, and a front wall 25 with an optional view window 26. The access openings 23 may be fitted with hinged or sliding doors 24 (hinged door shown). The lower section 12 is of tub-like construction to collect the spent ice blast media (water and partially melted ice particles) for discharge through a drain 31. A support 19, which may optionally be rotatable as indicated by the arrow in FIG. 1, is provided inside the housing 11, for supporting an article (not shown) to be treated by the ice blasting process. The box-like configuration of the cabinet 10 is but one example of the present invention, and alternative constructions, such as cylindrical, are within the scope of the present invention.

An ice blast nozzle 80 is mounted to the top panel 20, and is directed inwardly. An optional articulated mount 82 may be utilized to connect the ice blast nozzle 80 to the housing 11 to permit the nozzle 80 to be redirected through a range of angles. It is contemplated that the orientation of the nozzle 80 may be controlled in various ways, for example by direct manual manipulation, through a repetitive preprogrammed cycle, or by remote control. Although the disclosed ice blast cabinet 10 utilizes a single ice blast nozzle 80, it will be apparent to one of skill in the art that a plurality of nozzles could be incorporated into the cabinet, perhaps disposed in various locations in the cabinet 10.

It will be appreciated that the preferred apparatus having the blast nozzle 80 suspended from the cabinet ceiling and directed downwards and away from the front window will cause a directed flow of the blast debris and mist away from the window and towards the drain pan and the exhaust vent, thereby minimizing recontamination of the article from blast debris. Other nozzle orientations, including multiple nozzles, and oppositely disposed, horizontally-oriented or upwardly oriented nozzles are possible and contemplated by the present invention.

A blast media inlet port 32 provides a conduit to the ice blast nozzle 80, for receiving and transporting the entrained ice blast stream. A heat exchanger fluid inlet port 33 and fluid outlet port 34 are also provided for the energy management system 30 (See FIGS. 3 and 4), as discussed in more detail below. It is also contemplated that electrical power connectors 35 for optional features such as lighting, fans and motors (not shown) may also be provided. A mounting fixture 49 may also be provided for mounting an optional operator control panel 39.

During typical ice blasting operations, a portion of the ice particles do not fully melt upon impact with the article to be cleaned. The partially melted ice particles may accumulate over extended operation, potentially interfering with the ice blasting operation. It will also be appreciated that the melting and vaporizing ice blast media in the cabinet housing 11 absorb significant thermal energy in the phase change transition, which will tend to cause the volume in the cabinet 11 to cool, further inhibiting full melting of the ice particles. To avoid accumulation of ice in the cabinet, an energy management system is provided to facilitate melting and removal of the spent ice blast media. FIG. 2 shows an energy management system 30 including heating elements 41 and a heating plate 42 that are disposed partially within the housing lower section 12. The heating elements 41 are formed from a plurality of generally vertically oriented heated bars 45. The bars 45 may be heated in any number of ways. In one embodiment, the bars 45 may be formed as tubes or coils that are heated by circulating a relatively warm liquid through internal channels (not shown). In another embodiment, the bars 45 may be tubes that are warmed by providing electroresistive heating elements in the bars 45. The bars 45 may be solid or hollow and fabricated from a high conductivity metal material such as aluminum or steel, with the bars being heated at one or both ends. Similarly, the heating plate 42, disposed generally in the lower section 12 of the housing 11 can be heated using any conventional heating method.

Figure 3B:
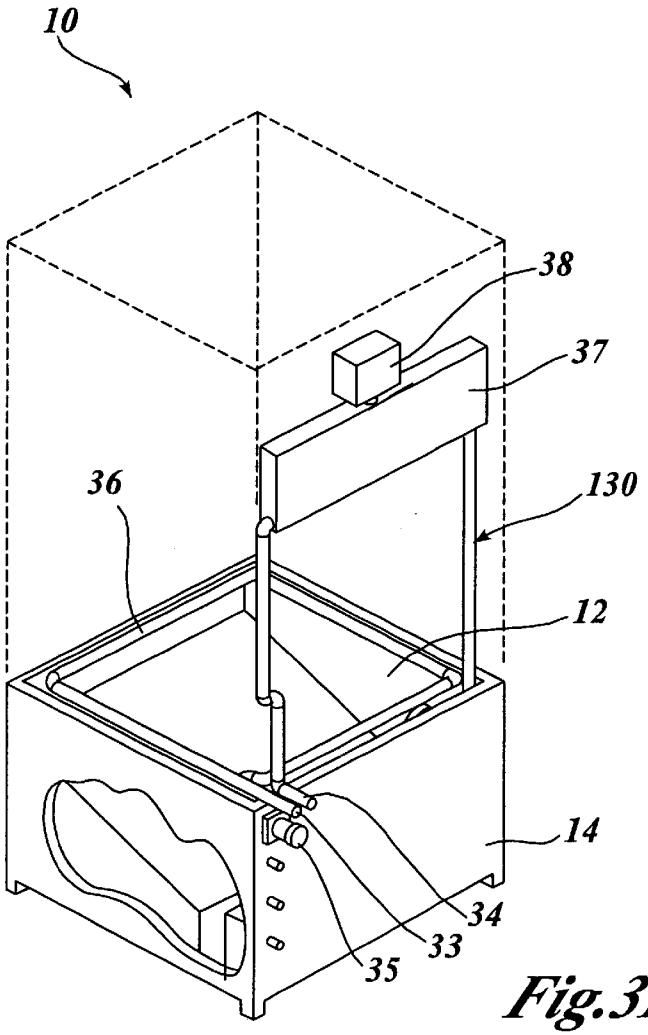
FIGS. 3A and 3B are perspective views of a second embodiment of an energy management system for the ice blast cabinet shown in FIGS. 1A and 1B.
Figure 3A:
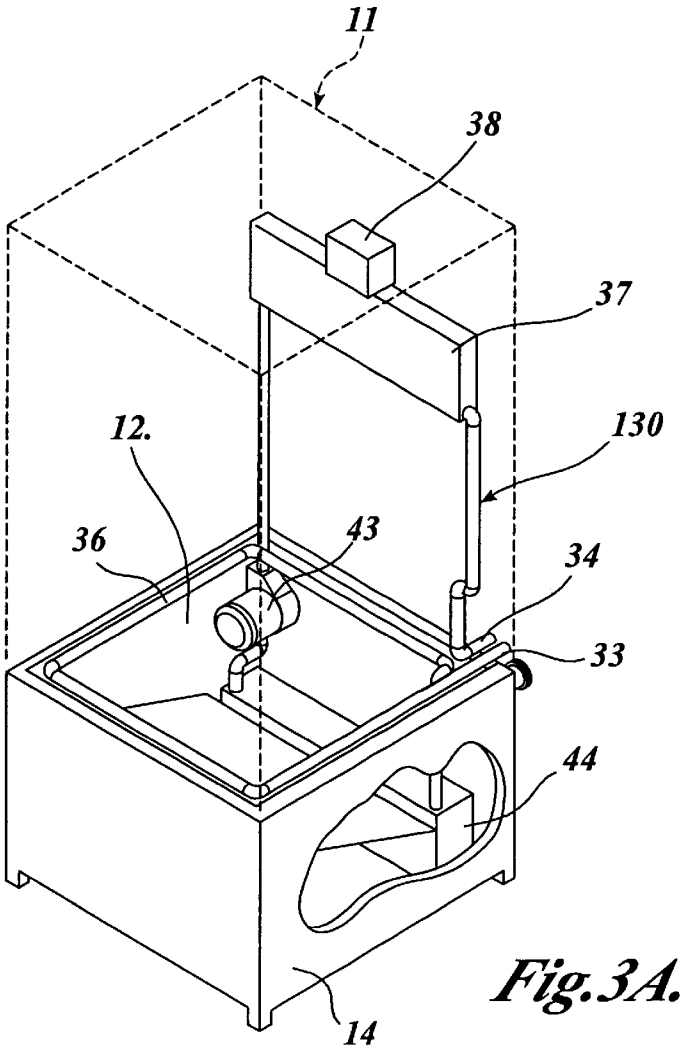

FIGS. 3A and 3B show a second embodiment of an energy management system 130 for preventing the accumulation of ice in the ice blast cabinet 10, wherein a heat exchanger fluid is circulated through a portion of the ice blast cabinet 10. This system 130 includes a piping assembly 36 which may be immersed in water in the lower tub section 12, and a liquid-to-air heat-exchanger 37 fluidly connected to the piping assembly 36, the heat exchanger 37 being similar to an automobile radiator. A heat-exchanger reservoir 44 may also be provided. As relatively warm heat exchanger fluid enters inlet 33, it first circulates through the piping assembly 36 to melt accumulated ice. The now relatively cool heat exchanger fluid then is circulated through the liquid-to-air heat exchanger 37 to cool even further before exiting outlet 34. The magnitude of the temperature drop in the heat exchanger fluid is controlled by the rate of fluid flow through the system 30, which is controlled by a pump 43. To maintain efficient circulation, an overhead reservoir 38 may optionally be provided, which acts an overflow tank.

The heat exchanger fluid may be water, or more preferably a fluid having a lower freezing point than water, for example a refrigerant such as a sodium chloride or calcium chloride brine, glycol, or glycol mixtures. Alternately, an evaporative refrigerant, such as a freon, may be utilized.

The heat exchanger fluid in the fluid reservoir 44 is maintained at a relatively low predetermined temperature by the surrounding water in which the reservoir 44 is immersed. Cooled fluid from the heat exchanger may be used to provide constant temperature liquid cooling for the refrigeration compressor 51 (see FIG. 4) used in the ice making process. Constant temperature cooling offers steady-state operating condition for the compressor—a condition that promotes mechanical dependability and long machine service life while also serving to reheat the de-icing fluid for the cabinet.

Typically, refrigeration compressors are either cooled by air or liquid. Air cooling does not offer year-round operating stability as the ambient temperature can have wide variations during the seasons. Particularly in a shop or plant environment, the discharged hot air from the compressor operation can compound the high ambient temperatures experienced in the summer. High ambient temperatures also reduce the thermodynamic efficiencies of the compressor, resulting in lower ice production capacity. This will impact the process quality. To maintain a stable process condition, in the embodiment shown in FIGS. 3A and 3B, the heat exchanger fluid is used to provide liquid cooling of the refrigeration compressors 51.

By properly controlling the flow of the heat exchanger fluid (by using a thermostatically controlled valve, not shown, similar to that used in an automobile radiator), a near-constant temperature steady-state operation of the refrigeration compressor 51 may be achieved. Furthermore, the heat exchanger fluid providing the constant temperature source is cooled to a very low temperature, thereby enhancing the thermodynamic efficiency of the compressor 51. For example, refrigeration capacities are normally stated at a standard 90 degree F. cooling. There is about a 6% increase in refrigeration capacity for a 10° F. decrease in cooling temperature. Thus, by providing a cooling fluid capable of cooling the refrigeration compressor to about 20° F. below the standard temperature, for example, an operating efficiency gain of approximately 12% can be achieved. The only energy input is that required to operate the circulation pump 43.

Figure 4:
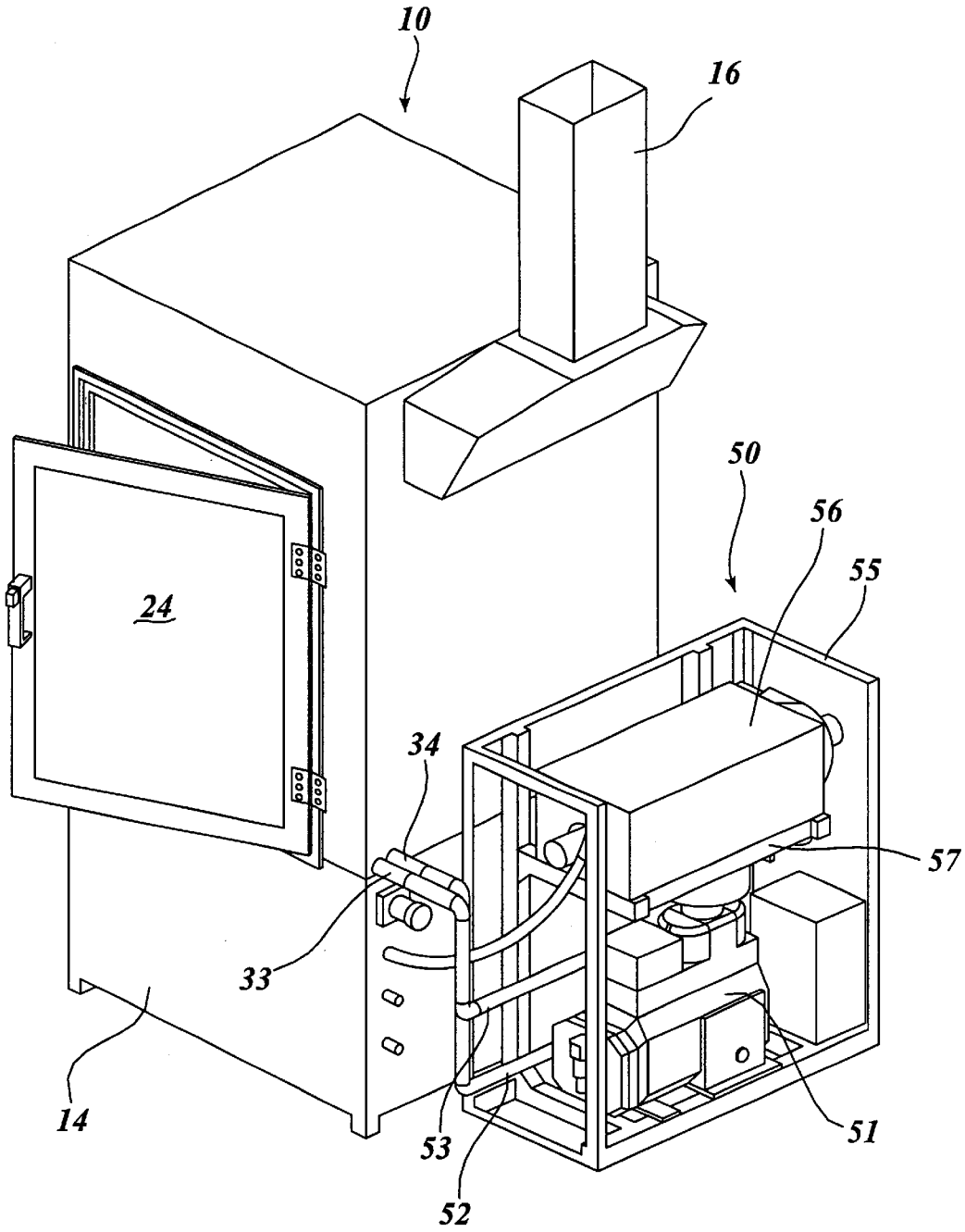
FIG. 4 is a perspective view of the ice blast cleaning cabinet shown in FIGS. 1A and 1B, fitted with a first embodiment of an ice making module.

FIG. 4 shows an embodiment of the present invention used in combination with an ice making module 50 that produces ice particles for the ice blasting operation. The ice making module 50 includes a refrigeration compressor 51 mounted within a support frame 55, and an ice particulate generator 56 mounted on a support shelf 57. An exemplary ice particle generator is disclosed in U.S. Pat. No. 6,001,000, incorporated herein by reference. The refrigeration compressor 51 is fluidly connected to the energy management system 130 through compressor cooling liquid inlet 52 and outlet 53. Low temperature heat exchanger fluid from the blast cabinet 10 is circulated via pump 43 to compressor cooling inlet 52 and through the compressor 51 where the heat exchanger fluid removes heat from the compressor 51. The heat exchanger fluid rises in temperature as it circulates through the compressor 51, and exits through compressor cooling outlet 53, into the inlet port 33 of energy management system 130. As discussed above, the heat exchanger fluid then warms the interior of the ice blast cabinet 10, where the heat exchanger fluid drops in temperature, exiting energy management outlet 34. In this arrangement, the heat exchanger fluid circulates through a closed loop where its temperature is regulated by the rate of circulation controlled by the pump 43. The heat exchanger fluid transfers waste heat from the compressor to the interior of the blast cabinet where it is used beneficially to prevent undesirably accumulation of ice.

Figure 5:
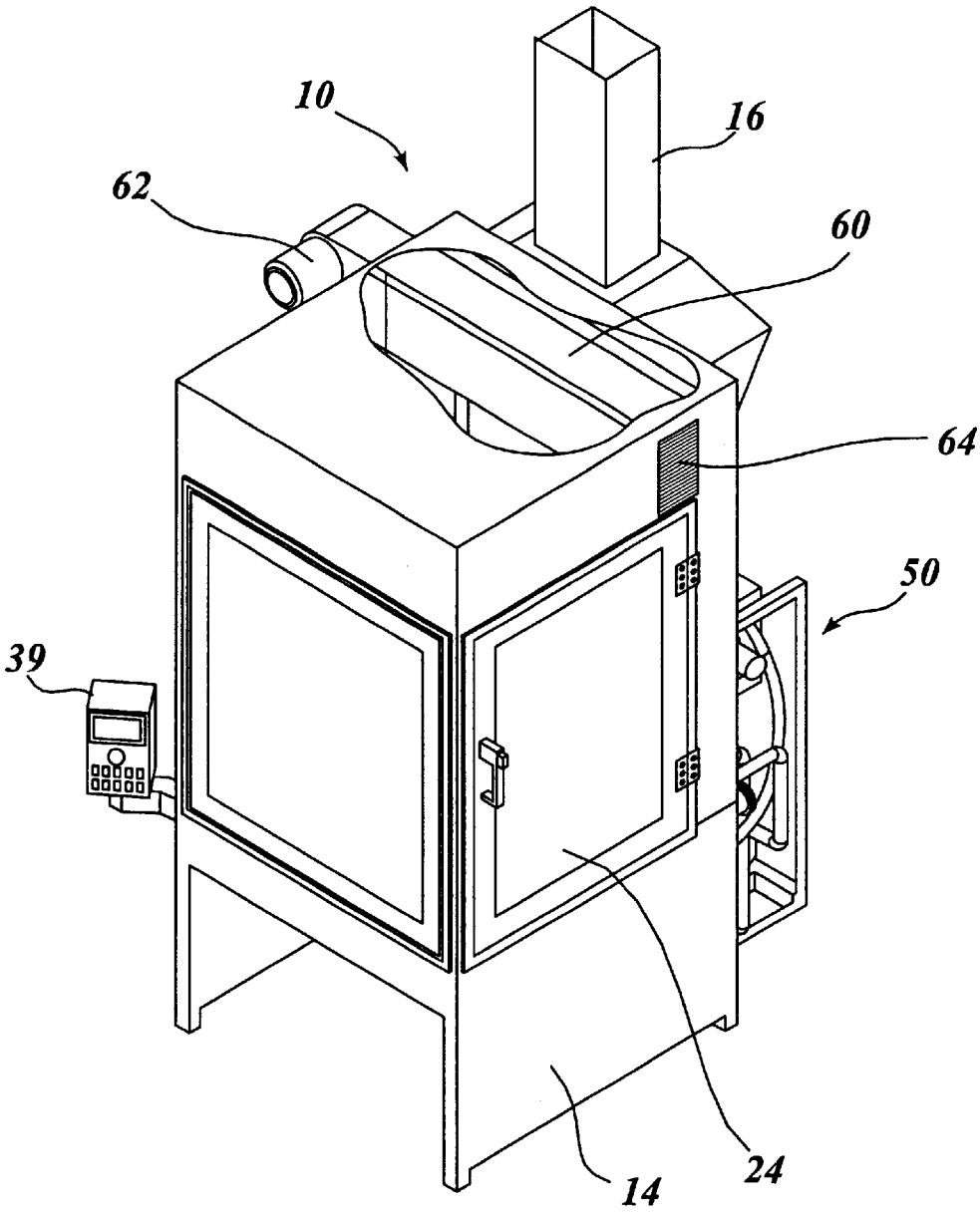
FIG. 5 is a perspective view of the ice blast cabinet shown in FIGS. 1A and 1B, fitted with a cooling air duct.

FIG. 5 show the ice blast cabinet disclosed in FIG. 4, further fitted with a ducting assembly 60 to chill ambient air that can be used to provide air conditioning for operator comfort. Ambient air is drawn in an air vent 64 and through the ducting 60 by a suitably sized fan motor 62 and out a second vent (not shown). The ducting 60 is preferably made from a material having high heat conductivity, and able to withstand the humid environment in the enclosure 11. Although the disclosed embodiment utilizes a straight duct 60 through the enclosure 11, it is contemplated that the heat transfer to the air stream may be enhanced many ways that are well known in the art. For example, the ducting may weave in serpentine fashion through the upper portion of the enclosure 11, and/or fins could be attached to the ducting.

Figure 6:
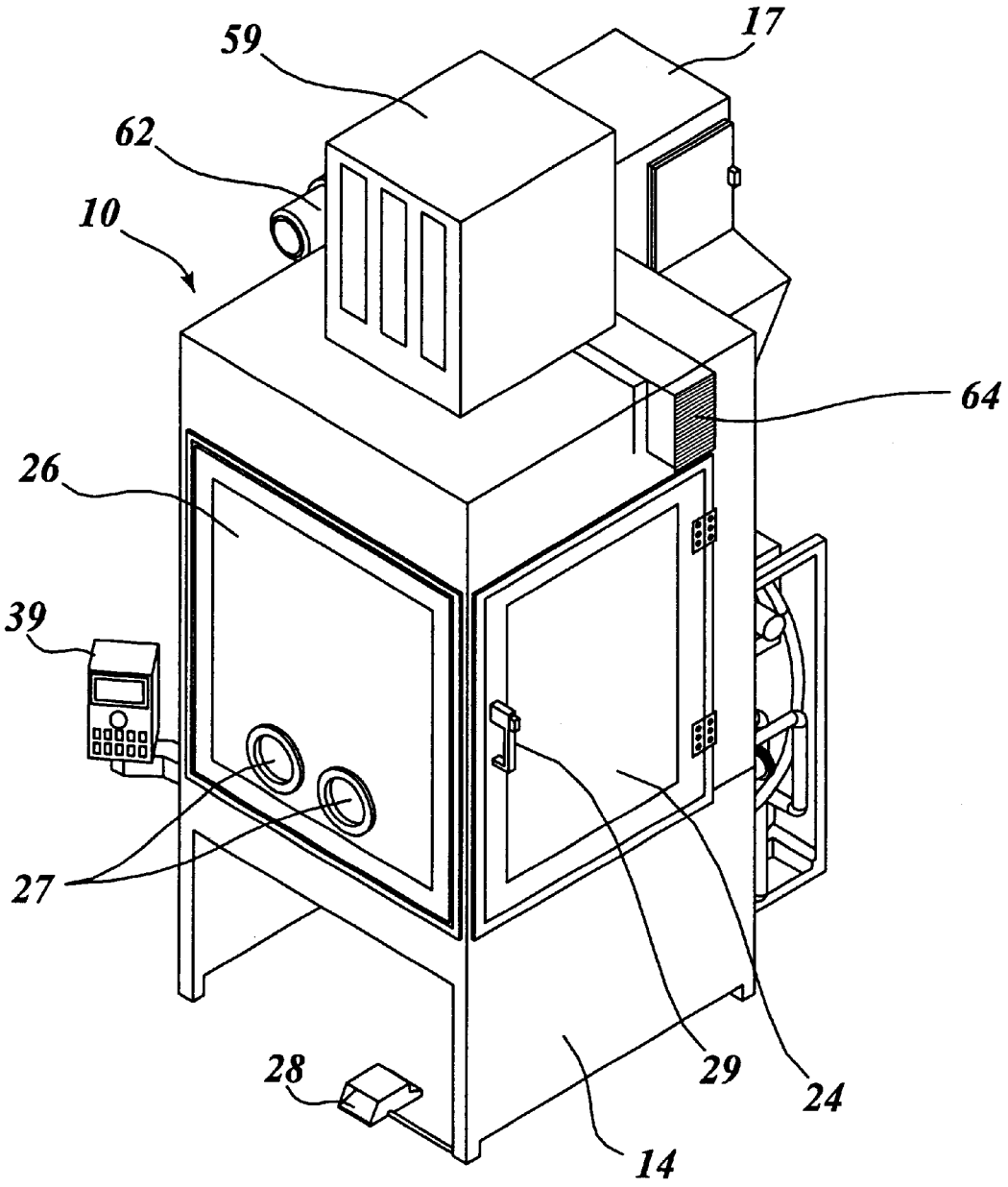
FIG. 6 is a perspective view of the ice blast cabinet shown in FIGS. 1A and 1B, fitted with a second embodiment of an ice making module and accessories for manual operation.

FIG. 6 shows a blast cabinet of the present invention fitted with an alternatively located ice making module 59 disposed above the enclosure 11. The blast cabinet 10 has a front window 26 with cut-out armholes 27 fitted with rubber work gloves (not shown), to permit manual manipulation of the article to be treated. A foot switch 28 allows the operator to keep both hands inside while blasting and still able to control the on/off function. The side access door 24 has a safety lockout mechanism 29 to interrupt blasting if the door 24 is accidentally opened. An optional de-mister and/or muffler system 17, as are well known in the art, is provided, rather than a simple exhaust vent to control the escape of moisture and blast noise, permitting the ice blast cabinet 10 to be operated in applications where access to an external vent is not conveniently available.

Figure 7:
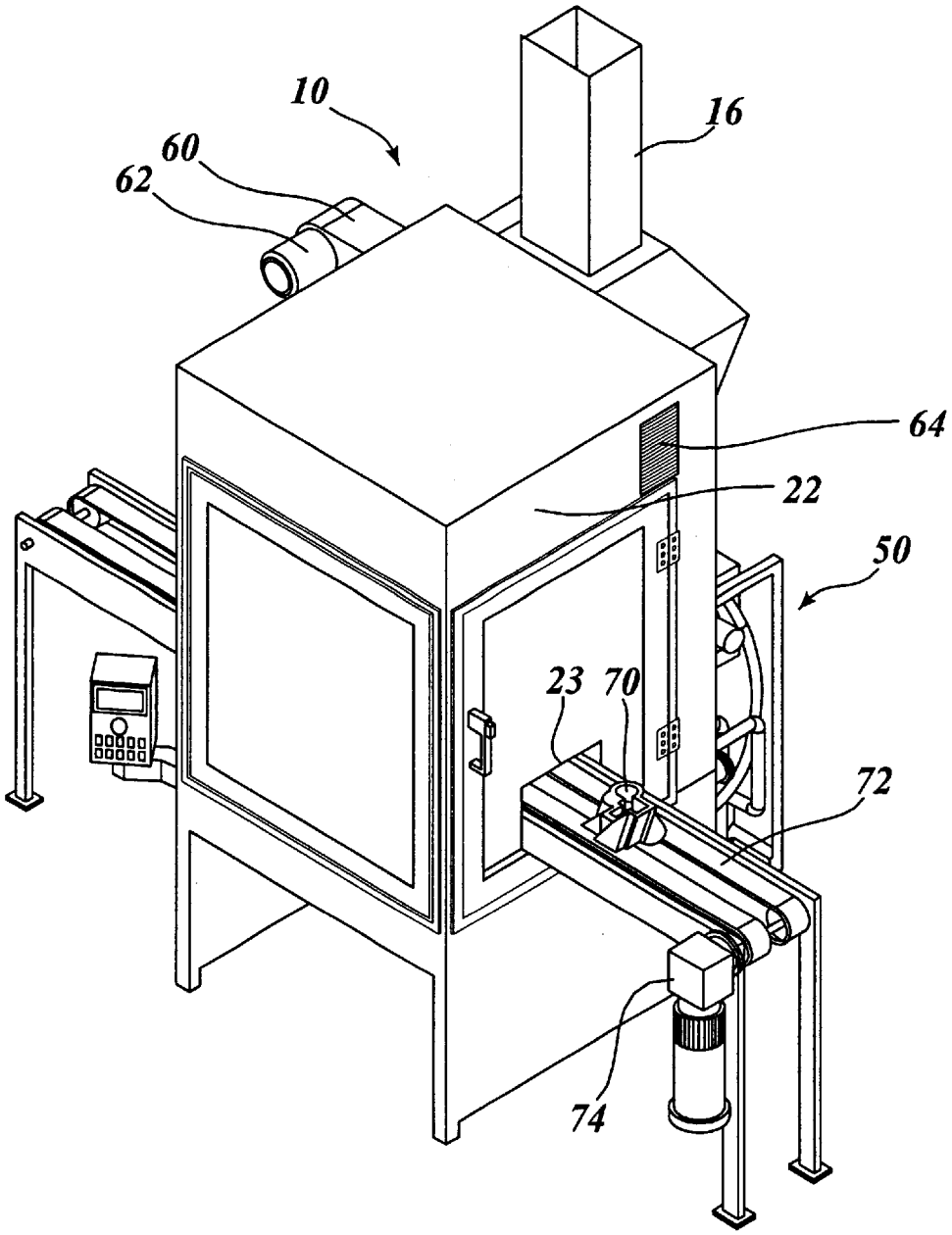
FIG. 7 is a perspective view of the ice blast cabinet shown in FIGS. 1A and 1B, fitted for automated operation.

An embodiment of the present invention, adapted for use in a continuous, automated application is shown in FIG. 7. In this embodiment a conveyor 72 is disposed through the ice blast cabinet 10, to transport parts 70 through the cabinet 10 through oppositely disposed access openings 23 in side walls 22. Suitably placed ice blast nozzle(s) 80 (See FIG. 1) within the cabinet directs ice particles onto the article 70 as it traverses through the ice blast cabinet 10. The speed of the conveyor 72 can be regulated by the drive mechanism 74 to ensure proper treatment of the part.

For manual operation, the blast cabinet is preferably of double wall construction and filled with sound insulating material. The front viewing window may be fitted with a motorized wiper (not shown) to improve visibility as the ice blast process produces a heavy mist which subsequently condenses on the window.

It will be appreciated that the preferred embodiment of the blast cabinet provides an energy management system that facilitated deicing and also improves refrigeration performance and efficiency. The invention will encompass other types of energy management systems, however, including for example electric de-icing such as heaters built into the cabinet. At least the lower portion of the blast should be water-tight and corrosion resistant. In the preferred embodiment, therefore, the interior surfaces are constructed of stainless steel, galvanized steel, coated steel, anodized aluminum, rubber or plastic materials.

While several preferred embodiments of the invention have been illustrated and described, it will be appreciated that various changes can be made therein without departing from the spirit and scope of the invention.

The embodiments of the invention in which an exclusive property or privilege is claimed are defined as follows:

1. A blast cabinet for cleaning surfaces of an article with an ice blast media, the blast cabinet comprising:

an enclosure including a lower portion having a drain, a wall portion and a top portion, and an interior support for the article;

at least one ice particulate blast nozzle disposed in the enclosure, the at least one blast nozzle being fluidly connected to a source of pressurized gas and ice particles, wherein the nozzle is directable towards the article on the support; and a thermal de-icing system coupled to the enclosure and operable to melt accumulations of ice particles within the enclosure, wherein the thermal de-icing system is disposed near the wall portion of the enclosure;

wherein the de-icing system comprises a heat exchanger disposed at least partially within the enclosure, the heat exchanger having a first end that receives relatively warm heat exchanger fluid from outside the enclosure for de-icing operations and a second end providing an outlet for relatively cold heat exchanger fluid.

2. The blast cabinet of claim 1, wherein the enclosure comprises a double wall construction.

3. The blast cabinet of claim 1, wherein the support for the article is rotatable.

4. The blast cabinet of claim 1, wherein the heat exchanger fluid comprises a refrigerant.

5. The blast cabinet of claim 1, wherein the heat exchanger fluid comprises glycol.

6. The blast cabinet of claim 1, wherein the de-icing system comprises at least one heating element disposed within the enclosure.

7. The blast cabinet of claim 1, wherein the at least one blast nozzle is articulatably mounted to the enclosure.

8. The blast cabinet of claim 1, wherein the enclosure further comprises first and second oppositely disposed openings, and the enclosure support comprises a conveyor operable to transport the article into the enclosure through the first opening and out of the enclosure through the second opening.

9. The blast cabinet of claim 1, further comprising an exhaust vent providing an outflow channel from the blast cabinet.

10. A blast cabinet for cleaning surfaces of an article with an ice blast media, the blast cabinet comprising:

an enclosure including a lower portion having a drain, a wall portion and a top portion, and an interior support for the article;

at least one ice particulate blast nozzle disposed in the enclosure, the at least one blast nozzle being fluidly connected to a source of pressurized gas and ice particles, wherein the nozzle is directable towards the article on the support; and a thermal de-icing system coupled to the enclosure and operable to melt accumulations of ice particles within the enclosure, wherein the thermal de-icing system is disposed near the wall portion of the enclosure;

further comprising a duct disposed through the enclosure having an air inlet and outlet, and a fan operable to circulate external air through the duct.

11. An ice blasting cabinet comprising:

an enclosure including a lower tub-like portion having a drain, a wall peripheral wall portion, a top portion, and an interiorly disposed support structure;

an ice particle generator for producing ice particles, the ice particle generator including a refrigeration system having a compressor;

a source of pressurized gas selectively producing a high speed gas stream that entrains at least some of the ice particles produced by the ice particle generator;

at least one blast nozzle disposed in the enclosure, the at least one blast nozzle receiving the high speed gas stream with entrained ice particles; and a de-icing system that, in cooperation with the compressor, provides a closed loop for circulating a heat exchanger fluid, the de-icing system comprising a heat exchanger and a piping assembly, the piping assembly having a proximal end fluidly connected to the compressor and receiving relatively warm heat exchanger fluid from the compressor, and a distal end fluidly connected to the heat exchanger, wherein the heat exchanger discharges relatively cold heat exchanger fluid to the compressor.

12. The blast cabinet of claim 11, wherein the support for the article is rotatable.

13. The blast cabinet of claim 11, wherein the heat exchanger fluid comprises glycol.

14. The blast cabinet of claim 11, wherein the de-icing system further comprises at least one heating element disposed in the enclosure.

15. The blast cabinet of claim 11, wherein the at least one blast nozzle is articulatably mounted to the enclosure.

16. The blast cabinet of claim 11, wherein the enclosure further comprises first and second oppositely disposed openings, and the enclosure support comprises a conveyor operable to transport the article into the enclosure through the first opening and out of the enclosure through the second opening.

17. The blast cabinet of claim 11, further comprising an exhaust vent providing an outflow channel for the compressed gas discharged from the at least one blast nozzle.

18. A method for ice blasting an article comprising:

placing the article on a support in an enclosure;

directing a high-speed jet of gas and ice particles at the article;

providing a heating system within the enclosure that is adapted to facilitate melting of accumulated ice particles from within the enclosure, wherein the heating system is disposed near a periphery of the enclosure; and draining substantially melted ice particles from the enclosure;

wherein the heating system comprises a piping assembly disposed substantially within the enclosure, the piping assembly receiving relatively warm heat exchanger fluid from outside the enclosure, circulating the heat exchanger fluid through a portion of the enclosure, and discharging the heat exchanger fluid from the enclosure.

19. The method of claim 18, further comprising closing the heat exchanger fluid loop by circulating the heat exchanger fluid through an apparatus external to the enclosure wherein the heat exchanger fluid is heated.

20. The method of claim 19, wherein the external apparatus is a component of an ice particle generator.

21. The method of claim 19, wherein the heat exchanger fluid comprises glycol.

* * * * *

UNITED STATES PATENT AND TRADEMARK OFFICE

CERTIFICATE OF CORRECTION

PATENT NO. : 6,719,612 B2
DATED : April 13, 2004
INVENTOR(S) : S. Visaisouk et al.

It is certified that error appears in the above-identified patent and that said Letters Patent is hereby corrected as shown below:

Title page,
Item [56], References Cited, FOREIGN PATENT DOCUMENTS, delete as duplicative "DE 40 22 401 A1 1991"; delete as duplicative "JP 63-156661 A 6/1988"; and delete as duplicative "JP 1-171766 A 7/1989".
Item [57], ABSTRACT,
Line 6, "on a articu-" should read -- on an articu- --
Line 12, "(36) a heat" should read -- (36), a heat --

Column 7,
Line 66, "a wall peripheral wall portion," should read -- a peripheral wall, --

Signed and Sealed this

Twenty-seventh Day of July, 2004

JON W. DUDAS
*Acting Director of the United States Patent and Trademark Office*